US011472208B2

(12) United States Patent
Mizusawa

(10) Patent No.: US 11,472,208 B2
(45) Date of Patent: Oct. 18, 2022

(54) PRINT APPARATUS, METHOD FOR CONTROLLING THE SAME, AND STORAGE MEDIUM

(71) Applicant: SEIKO EPSON CORPORATION, Tokyo (JP)

(72) Inventor: Nobutada Mizusawa, Sapporo (JP)

(73) Assignee: Seiko Epson Corporation, Tokyo (JP)

( * ) Notice: Subject to any disclaimer, the term of this patent is extended or adjusted under 35 U.S.C. 154(b) by 18 days.

(21) Appl. No.: 17/062,852

(22) Filed: Oct. 5, 2020

(65) Prior Publication Data

US 2021/0101393 A1 Apr. 8, 2021

(30) Foreign Application Priority Data

Oct. 8, 2019 (JP) ..... JP2019-185027

(51) Int. Cl.
*B41J 13/00* (2006.01)
*B41J 11/00* (2006.01)

(52) U.S. Cl.
CPC ..... *B41J 13/0009* (2013.01); *B41J 11/007* (2013.01)

(58) Field of Classification Search
CPC ..... B41J 11/007; B41J 29/393; B41J 29/38; B41J 11/42; B41J 2/04573; B41J 11/0095; B41J 13/0009; B41J 2/04501
See application file for complete search history.

(56) References Cited

U.S. PATENT DOCUMENTS

2009/0148181 A1* 6/2009 Niihara ..... G03G 15/6591 399/126
2009/0162110 A1* 6/2009 Murayama ..... G03G 15/5058 399/301

FOREIGN PATENT DOCUMENTS

JP 2009-149398 A 7/2009

* cited by examiner

*Primary Examiner* — Jannelle M Lebron
(74) *Attorney, Agent, or Firm* — Workman Nydegger

(57) ABSTRACT

A print apparatus includes a print unit configured to perform printing on a print medium, a transport belt on which the print medium is mounted, a driving section configured to move the belt in a predetermined belt movement direction so as to transport the print medium, a detection section configured to detect marks for detection of a movement amount formed on side ends of the transport belt, and a driving controller configured to control the driving section based on a result of the detection performed by the detection section. The driving controller obtains an error of movement amounts of the transport belt based on the result of the detection performed by the detection section and performs control such that the obtained error is corrected.

9 Claims, 5 Drawing Sheets

PRINT APPARATUS, METHOD FOR CONTROLLING THE SAME, AND STORAGE MEDIUM

The present application is based on, and claims priority from JP Application Serial Number 2019-185027, filed Oct. 8, 2019, the disclosure of which is hereby incorporated by reference herein in its entirety.

BACKGROUND

1. Technical Field

The present disclosure relates to a print apparatus, a method for controlling the print apparatus, and a storage medium.

2. Related Art

In general, in print apparatuses transporting a print medium using a belt, a method for detecting a state of the belt is employed (refer to JP-A-2009-149398, for example). JP-A-2009-149398 discloses a configuration in which a reference pattern is formed out of a print range on the belt based on data of a size of a medium to be used for printing and the reference pattern is optically read so that deviation of the belt is detected.

In the configuration disclosed in JP-A-2009-149398, an operation of forming the reference pattern on the belt and an operation of cleaning the belt before or after the reference pattern is formed are required, and an operation of detecting a state of the belt is complicated.

SUMMARY

According to an aspect of the present disclosure, a print apparatus includes a print section configured to perform printing on a print medium, a belt on which the print medium is mounted, a driving section configured to move the belt in a predetermined movement direction so as to transport the print medium, a detection section configured to detect marks for detection of a movement amount formed on side ends of the belt, and a driving controller configured to control the driving section based on a result of the detection performed by the detection section. The driving controller obtains an error of movement amounts of the belt based on the result of the detection performed by the detection section and performs control such that the obtained error is corrected.

In the print apparatus, the driving controller may perform control such that an error between a movement amount of the belt obtained based on a result of the detection of the detection section and a preset movement amount is corrected.

In the print apparatus, the driving section may include a motor as a power source driving the belt, and the driving controller adjusts a rotation speed of the motor so as to correct the error between the movement amounts of the belt.

In the print apparatus, the plurality of marks may be formed at an equal interval in the movement direction in opposite ends of the belt with the movement direction as a reference, and the driving controller may detect oblique transport of the belt based on a result of detection of the marks formed on one of the side ends of the belt performed by the detection section and a result of detection of the marks formed on the other of the side ends of the belt performed by the detection section.

In the print apparatus, when the driving section performs an operation of moving the belt in a direction opposite to the movement direction, the driving controller may perform control such that the belt is moved in the movement direction by a movement amount of the belt in the opposite direction before the print section performs printing on the print medium.

In the print apparatus, the detection section may be an optical sensor which is disposed on a downstream of a mounting start position where mounting of the print medium on the belt is started in the movement direction and on an upstream of the print section and which optically reads the marks.

In the print apparatus, the print section may include a print head forming an image by ejecting ink to the print medium and a carriage which includes the print head and which performs scanning in a direction intersecting with the movement direction, and the detection section may be an optical sensor which is mounted on the carriage and which optically reads the marks.

According to another aspect of the present disclosure, a method for controlling a print apparatus which includes a print section performing printing on a print medium and a belt on which the print medium is mounted and which transports the print medium by moving the belt in a predetermined movement direction includes detecting marks for detection of a movement amount formed on side ends of the belt, and performing control such that an error between movement amounts of the belt is obtained based on a result of the detection of the marks and the obtained error is corrected.

According to a further aspect of the present disclosure, a non-transitory computer-readable storage medium stores a control program to be executed by a control section controlling a print apparatus which includes a print section performing printing on a print medium and a belt on which the print medium is mounted and which transports the print medium by moving the belt in a predetermined movement direction. The program causes the controller to detect marks for detection of a movement amount formed on side ends of the belt, and perform control such that an error between movement amounts of the belt is obtained based on a result of the detection of the marks and the obtained error is corrected.

DESCRIPTION OF EXEMPLARY EMBODIMENTS

Figure 1:
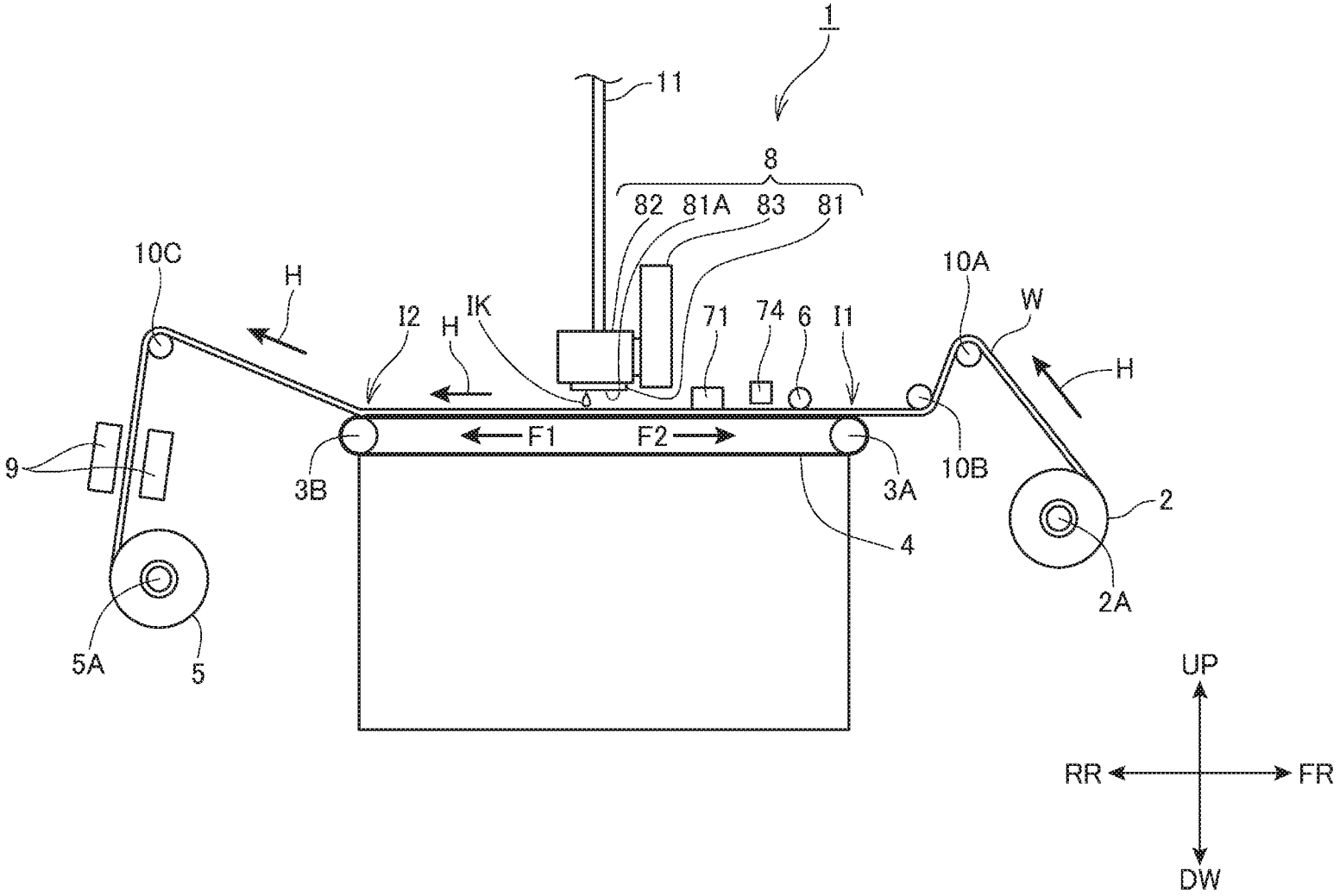
FIG. 1 is a diagram schematically illustrating a configuration of a printer.

FIG. 1 is a diagram schematically illustrating a configuration of a printer 1 as an example to which a print apparatus of the present disclosure is applied. In FIG. 1 and drawings described below, a front of an installation state of the printer 1 is indicated by a reference symbol FR and a rear of the printer 1 is indicated by a reference symbol RR. Furthermore, right of the printer 1 is indicated by a reference symbol R, left of the printer 1 is indicated by a reference symbol L, an upper side of the printer 1 is indicated by a reference symbol UP, and a lower side of the printer 1 is indicated by a reference symbol DW.

The printer 1 is an ink jet print apparatus which includes a print head 81 ejecting ink IK and which forms an image on a print medium W by ejecting the ink IK.

The print medium W used in the printer 1 may be one of various materials including paper and a sheet of synthetic resin. For example, paper dedicated for ink jet recording, such as plain paper, high-quality paper, and glossy paper, may be used. In this embodiment, fabric of natural fiber, synthetic fiber, or the like is used as the print medium W. The printer 1 functions as a textile printer performing printing on the print medium W by attaching the ink IK on a print surface of the print medium W, and the print medium W may be referred to as a member to be printed.

The print head 81 may eject ink of cyan (C), ink of magenta (M), ink of yellow (Y), and ink of black (K), for example. Furthermore, the print head 81 may eject ink IK of light cyan, ink IK of light magenta, ink IK of orange, ink IK of green, ink IK of gray, ink IK of light gray, and ink IK of white, and may eject ink IK of metallic color. Furthermore, soakage enhancing penetration of the ink IK in the print medium W may be ejected from the print head 81.

The printer 1 includes a delivery device 2, driven rollers 10A to 10C, transport rollers 3A and 3B, a transport belt 4, and a reeling device 5 as devices transporting the print medium W. These sections constitute a transport mechanism 140 described below.

The delivery device 2 delivers a rolled long print medium W to the transport belt 4. The delivery device 2 is positioned in an uppermost stream in a transport direction H of the print medium W. The delivery device 2 rotates a rotation shaft 2A in a counterclockwise direction in FIG. 1 so that the print medium W set in the rotation shaft 2A is transported to the transport belt 4 through the driven rollers 10A and 10B.

The transport rollers 3A and 3B are a pair of rollers driving the transport belt 4 by power of a transport motor 141 described below. At least one of the transport rollers 3A and 3B may be a driving roller and the other may be a driven roller.

The transport belt 4 is formed in an endless shape by coupling end portions of a rectangle flexible sheet formed of gum, synthetic resin, or a composite of the gum or the synthetic resin and fibers. The transport belt 4 is an example of a belt of the present disclosure. The transport belt 4 is hung on the transport rollers 3A and 3B and circularly moved in front and rear directions of the printer 1 in accordance with rotation of the transport rollers 3A and 3B.

In a front portion of the printer 1, the print medium W delivered by the delivery device 2 is mounted on the transport belt 4, and the transport belt 4 transports the print medium W in the transport direction indicated by the reference character H toward a rear portion of the printer 1. Here, a position on which the print medium W is in contact with the transport belt 4 is determined as a mounting start position I1.

In the transport belt 4, a contact surface which is in contact with the print medium W has viscosity. For example, when a glue belt having a viscosity layer on the contact surface is used as the transport belt 4, the print medium W is held by the transport belt 4 by the viscosity of the viscosity layer and moved in the transport direction H along with the transport belt 4. Note that the transport belt 4 is not limited to the glue belt and an electrostatic absorption belt absorbing the print medium W by static electricity may be used, for example.

As described below, the printer 1 may rotate the transport rollers 3A and 3B in a reversed direction. In this case, the transport belt 4 circularly moves the print medium W in a direction opposite to the transport direction H.

In the description below, a moving direction of the transport belt 4 when the print medium W is transported in the transport direction H is determined as a belt moving direction F1. A direction of movement of the transport belt 4 opposite to the belt moving direction F1 is determined as a belt moving direction F2. The belt moving direction F1 corresponds to an example of a moving direction of the present disclosure. Assuming that the belt moving direction F1 is a normal direction, the belt moving direction F2 corresponds to a reversed direction. Furthermore, the belt moving direction F1 may be a first direction, and the belt moving direction F2 may be a second direction.

Although the transport belt 4 is an endless belt circularly moved in this embodiment, a movement mode of the transport belt 4 may be arbitrarily changed. The belt moving directions F1 and F2 particularly indicate moving directions of the transport belt 4 in a position facing the print head 81, but do not only indicate moving directions of the transport belt 4 circularly moved.

The printer 1 includes a pressing roller 6, a medium sensor 71, and a print unit 8 along a movement path of the print medium W.

The pressing roller 6 and the medium sensor 71 are disposed on a downstream relative to the mounting start position I1 in the transport direction H. The pressing roller 6 is biased by a biasing mechanism, such as a spring, not illustrated, toward the transport belt 4 so that the print medium W is pressed on the transport belt 4. By this, the print medium W is tightly supported by the transport belt 4 so that floating of the print medium W is suppressed. The pressing roller 6 is rotatable in accordance with transport of the print medium W so that a mark of the pressing roller 6 is not left on the print medium W.

The medium sensor 71 is an optical sensor including a light emitting section emitting light to the print medium W and a light receiving section receiving and detecting light. For example, the medium sensor 71 is configured as a reflection optical sensor receiving reflection light from the print medium W using the light receiving section. A controller 100 described below detects the print medium W beneath the medium sensor 71 based on an amount of light detected by the light receiving section of the medium sensor 71. Furthermore, the controller 100 may detect a distance from the medium sensor 71 to a surface of the print medium W based on a difference between a light emission timing and a light reception timing of the medium sensor 71.

The print unit 8 is disposed on a downstream of the medium sensor 71 in the transport direction H. The print unit 8 includes the print head 81 forming an image on the print medium W, a carriage 82 having the print head 81 mounted thereon, and a gap adjustment mechanism 83 adjusting a relative position of the carriage 82 relative to the print medium W.

The print head 81 includes a plurality of nozzles opened toward the print medium W and eject the ink IK from the nozzles to the print medium W so as to form an image on the print medium W. A process of forming an image by the ink IK is referred to as printing. Furthermore, a surface of the print head 81 on which the nozzles are opened is referred to as a nozzle surface 81A, and a surface of the print medium W on which the ink IK is attached is referred to as a print surface.

An ink supply path 11 is coupled to the print head 81. The ink IK is supplied from an ink storage section, not illustrated, through the ink supply path 11 to the print head 81.

The carriage 82 reciprocates in a scanning direction indicated by a reference character K as described below on the print medium W. The print head 81 is moved on the print medium W in the scanning direction K in accordance with the movement of the carriage 82.

The gap adjustment mechanism 83 adjusts a work gap WG which is a distance from the print medium W to the nozzle surface 81A of the print head 81 by moving the carriage 82 in a vertical direction.

The print unit 8 may be accommodated in an exterior package not illustrated. The printer 1 may include an exterior package covering a range from the mounting start position I1 to the print unit 8.

In a downstream of the print unit 8, the print medium W is peeled from the transport belt 4, guided by the driven roller 10C, and reeled by the reeling device 5. A position in which the print medium W is separated from the transfer belt 4 is determined as a mounting end position I2.

The reeling device 5 rotates in a counterclockwise direction in FIG. 1 with a rotation shaft 5A at a center so that the print medium W is reeled by a reel set in the rotation shaft 5A in a rolled manner.

A drying unit 9 is disposed between the driven roller 10C and the reeling device 5. The drying unit 9 dries the ink IK attached to the print medium W before the print medium W is reeled by the reeling device 5. For example, the drying unit 9 including a chamber accommodating the print medium W and a heater disposed inside the chamber heats the print medium W to be dried. A position of the drying unit 9 is at least between the print head 81 and the reeling device 5 in the transport direction H and is not limited to the downstream of the driven roller 10C.

The printer 1 includes a belt position sensor 74. The belt position sensor 74 is disposed in the movement path of the transport belt 4. The belt position sensor 74 detects marks 50 described below of the transport belt 4.

The belt position sensor 74 of this embodiment is a reflection optical sensor which is disposed over the transport belt 4 and the print medium W, which emits light to the transport belt 4, and which detects reflection of the light. An in-mark-sensor (IMS) used as a sensor for a print apparatus may be used as the belt position sensor 74, for example. The IMS detects density of dots formed by ink on a print medium, such as a sheet. The belt position sensor 74 corresponds to an example of an optical sensor of the present disclosure.

The belt position sensor 74 at least performs optical detection on the transport belt 4, and a charge coupled device (CCD) scanner or a camera capable of capturing monochrome images or color images may be used instead of the reflection optical sensor. Alternatively, a transmission optical sensor may be used.

Figure 2:
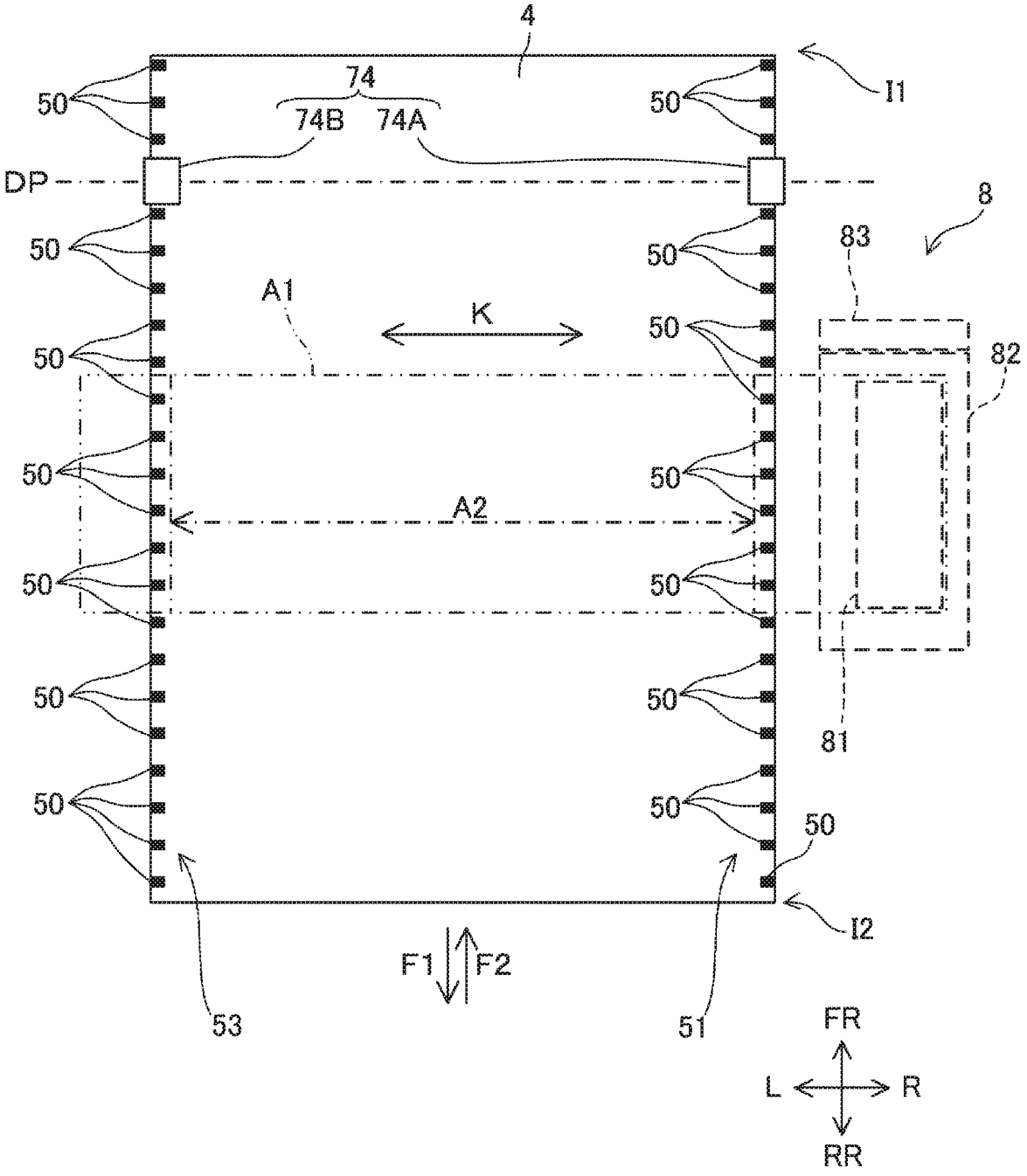
FIG. 2 is a diagram illustrating a configuration of a transport belt.
Figure 3:
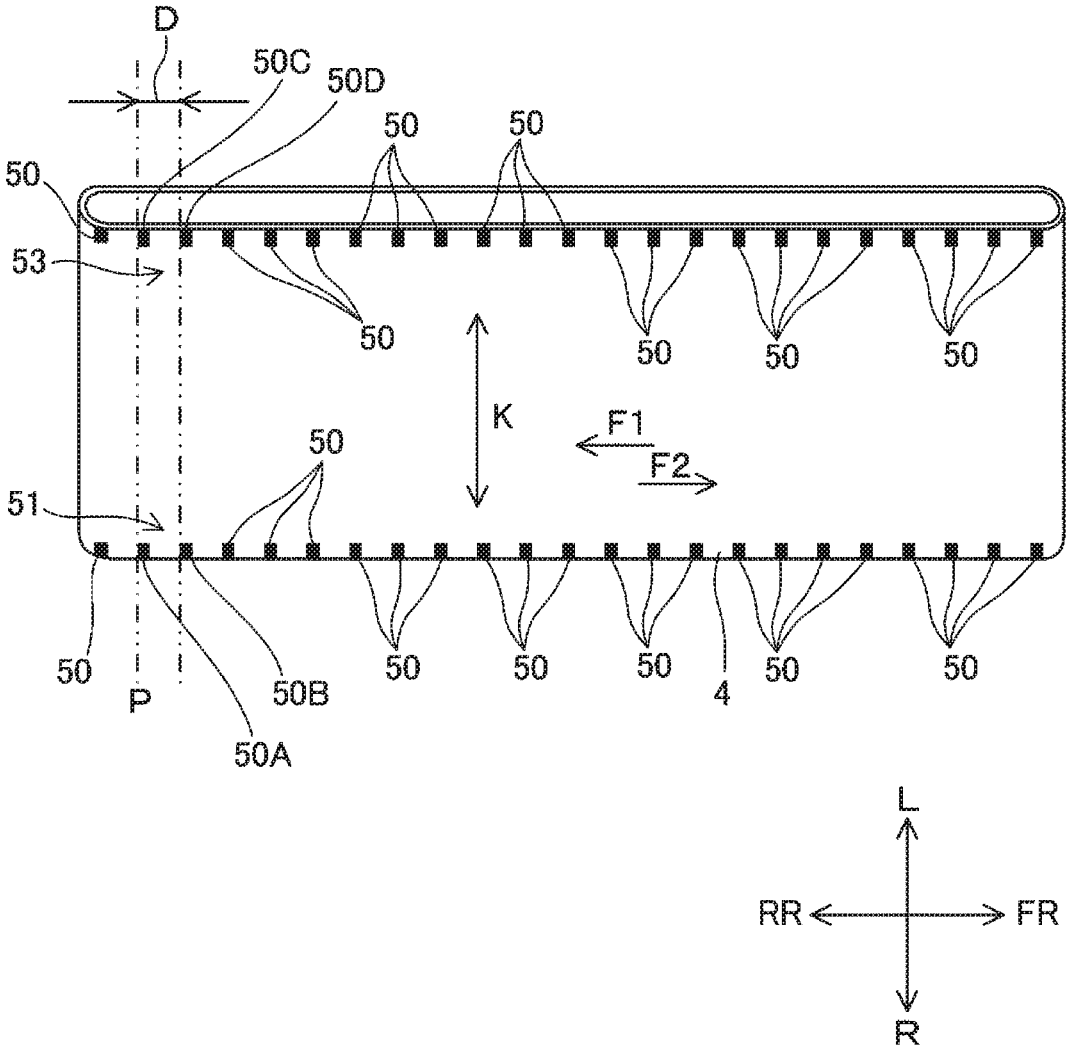
FIG. 3 is a plan view of an essential portion of the printer.

FIG. 2 is a plan view of an essential portion of the printer 1. In FIG. 2, a state in which the print medium W is not mounted on the transport belt 4 is illustrated. FIG. 3 is a diagram illustrating a configuration of the transport belt 4, and is a perspective view schematically illustrating the transport belt 4 which is circularly transported. In FIGS. 2 and 3, the belt moving directions F1 and F2, and front, rear, left, and right directions correspond to those in FIG. 1.

The carriage 82 reciprocates on the transport belt 4 in the scanning direction K. The scanning direction K intersects with the transport direction H, and the scanning direction K orthogonally intersects with the transport direction H in this embodiment, for example. The printer 1 forms an image in a range extending in the scanning direction K and the transport direction H.

The carriage 82 may be moved to a position outside of the print medium W rightward in the scanning direction K. This position is referred to as a home position. A maintenance mechanism is disposed to execute maintenance of the print head 81 including flushing and cleaning performed to suppress clogging of the nozzles of the print head 81.

A range in which the print head 81 performs scanning in the scanning direction K is indicated as a scanning range A1 in FIG. 2. In the scanning range A1, a range in which the print medium W is disposed and printing is performed by the print head 81 is indicated as a print region A2. The print region A2 indicates a practical region in which the print medium W is disposed in the printer 1 and is smaller than a physical limit of a range in which the print head 81 ejects ink.

As illustrated in FIGS. 2 and 3, the transport belt 4 has the plurality of marks 50. The marks 50 are positioned on a surface of the transport belt 4 and may be optically distinguished from the surface of the transport belt 4. Specifically, in the transport belt 4, at least positions of the marks 50 are optically detected. The marks 50 may be detected by the reflection optical sensor. In this case, the marks 50 have a color and reflection wavelength characteristics which are different from those of the surface of the transport belt 4, for example, and formed by a method for attaching stickers on the transport belt 4 or by a method for applying paint on the transport belt 4. Furthermore, the marks 50 may be detected by the transmission optical sensor, and in this case, the marks 50 may be through holes drilled in the transport belt 4 or translucent members disposed in the through holes. Alternatively, the transport belt 4 may be formed by a translucent member and the marks 50 may be formed by a member having transparent wavelength characteristics different from those of the transport belt 4.

The marks 50 are formed on the transport belt 4 at a time when the transport belt 4 is fabricated or after the transport belt 4 is fabricated and before the transport belt 4 is attached to the printer 1.

The plurality of marks 50 are aligned on opposite end portions of the transport belt 4 in the scanning direction K. A mark line 51 is formed by the plurality of marks 50 aligned in the belt moving direction F1 in one end portion of the transport belt 4 near the home position in the scanning direction K. Similarly, a mark line 53 is formed by the plurality of marks 50 aligned in the belt moving direction F1 in the other end portion of the transport belt 4 opposite to the home position in the scanning direction K.

It is assumed in FIG. 3 that marks 50A and 50B are included in the plurality of marks 50 included in the mark line 51, and marks 50C and 50D are included in the plurality of marks 50 included in the mark line 53.

Before the transport belt 4 is attached on the printer 1, the marks 50 included in the mark lines 51 and 53 are disposed at a regular interval.

In the mark line 51, the mark 50A and the mark 50B adjacent to the mark 50A included in the mark line 51 are disposed with an interval D interposed therebetween, and all the marks 50 in the mark line 51 are disposed with the interval D interposed therebetween. The interval among the marks 50 in the mark line 51 and the interval among the marks 50 in the mark line 53 are the same as each other. For example, the mark 50C and the mark 50D adjacent to the mark 50C included in the mark line 53 are disposed with the interval D interposed therebetween, and all the marks 50 in the mark line 53 are disposed with the interval D interposed therebetween.

Furthermore, the marks 50 in the mark line 51 and the marks 50 in the mark line 53 are in the same positions in the belt moving direction F1. For example, the mark 50A in the mark line 51 and the mark 50C in the mark line 53 are in the same position P in the belt moving direction F1. Similarly, the mark 50B and the mark 50D are in the same position, and the other marks 50 are the same.

As illustrated in FIG. 2, the belt position sensor 74 includes two belt position sensors 74A and 74B. The belt position sensors 74A and 74B are reflection optical sensors described above. The belt position sensor 74A is disposed in a position corresponding to the mark line 51 in the scanning direction K, or a position directly over the mark line 51, for example. The belt position sensor 74B is disposed in a position corresponding to the mark line 53 in the scanning direction K, or a position directly over the mark line 53, for example. When the belt position sensors 74A and 74B are not distinguished from each other, they are referred to as the belt position sensor 74 in this embodiment.

The printer 1 causes the belt position sensor 74A to detect the marks 50 included in the mark line 51 and causes the belt position sensor 74B to detect the marks 50 included in the mark line 53. A detection position of the belt position sensors 74A and 74B are indicated by a reference character DP in FIG. 2. The detection position DP is on a downstream relative to the mounting start position I1 in the transport direction H and on an upstream of the scanning range A1 of the print head 81.

Although the marks 50 may be disposed in arbitrary positions on the surface of the transport belt 4, the marks 50 are preferably disposed in positions which do not overlap with the print medium W. In this case, even in a state in which the print medium W is mounted on the transport belt 4, the marks 50 may be detected by the belt position sensors 74A and 74B. Specifically, the mark line 51 and the mark line 53 are preferably positioned outside the print region A2 on the transport belt 4.

The belt position sensors 74A and 74B are in the same position in the belt moving direction F1. Specifically, the belt position sensors 74A and 74B detect the marks 50 in the detection position DP. Therefore, a timing when the belt position sensor 74A detects one of the marks 50 and a timing when the belt position sensor 74B detects one of the marks 50 are the same. For example, the mark 50A and the mark 50C in FIG. 3 are detected at the same timing.

Before the transport belt 4 is mounted on the printer 1, wear and extension of the transport belt 4 caused by a mounting operation on the printer 1 and use of the printer 1 do not occur. A state in which the entire transport belt 4 which does not have a temperature difference or has a little temperature difference before being mounted on the printer 1 is referred to as a reference state of the transport belt 4. In the reference state of the transport belt 4, the marks 50 in the mark line 51 and the marks 50 in the mark line 53 are in the same positions in the belt moving direction F1, and the adjacent two marks 50 in the mark lines 51 and 53 have the constant interval D interposed therebetween. Accordingly, when the transport belt 4 maintains the reference state while the transport belt 4 is mounted on the printer 1, the belt position sensors 74A and 74B detect the marks 50 at the same timing with the certain interval.

However, the belt position sensors 74A and 74B may not detect the marks 50 at the certain interval in practice. Furthermore, the timing when the belt position sensor 74A detects one of the marks 50 and the timing when the belt position sensor 74B detects one of the marks 50 may be shifted. This occurs due to wear of the transport belt 4 caused by use of the printer 1, extension of the transport belt 4 caused by applying of tension to the transport belt 4, and partial expansion and contraction of the transport belt 4 caused by a change in temperature. Furthermore, when cross-sectional surfaces of the transport rollers 3A and 3B are not an exact circle or are eccentric, unevenness of a transport speed occurs even when the transport speed of the transport rollers 3A and 3B is constant. Specifically, even when the transport rollers 3A and 3B rotates at a constant angular velocity, a transport amount of the transport belt 4 transported in a unit of time varies, and therefore, unevenness of a movement speed of the transport belt 4 occurs. Accordingly, intervals of the detection timings of the belt position sensors 74A and 74B vary.

Furthermore, when the transport speed of the transport belt 4 on the mark line 51 side and the transport speed on the mark line 53 side are shifted from each other, the transport belt 4 may be obliquely transported. The oblique transport of the transport belt 4 is a state in which the transport belt 4 moves in a direction shifted from the belt moving direction F1. The oblique transport occurs when the transport belt 4 extends and an amount of extension of the transport belt 4 is different in the scanning direction K. Furthermore, when the transport belt 4 may be obliquely transported when a movement direction of the transport belt 4 is reversed from the belt moving direction F1 to the belt moving direction F2 or when the reversed belt moving direction F2 is further reversed to the belt moving direction F1. This occurs due to a shift between the transport rollers 3A and 3B and the transport belt 4 and slack of the transport belt 4 generated when the movement direction of the transport belt 4 is reversed. The shift and the slack unevenly generated in the scanning direction K cause the oblique transport. These events easily occur due to a large gap between the transport rollers 3A and 3B, the heavy transport belt 4, large tension applied to the transport belt 4 between the transport rollers 3A and 3B, and the like, when the printer 1 is a large print apparatus.

The printer 1 detects a change in a transport speed of the transport belt 4 in the belt moving direction F1 based on an interval between the timings when the belt position sensors 74A and 74B detect the marks 50. When unevenness or a change in the transport speed of the transport belt 4 occurs, transport of the print medium W is stabilized by correcting a rotation speed of the transport rollers 3A and 3B driving the transport belt 4. Furthermore, the printer 1 obtains a difference between the detection timing of the belt position sensor 74A and the detection timing of the belt position sensor 74B so as to detect oblique transport of the transport belt 4.

In this way, the marks 50 are used to detect a movement amount of the transport belt 4.

Figure 4:
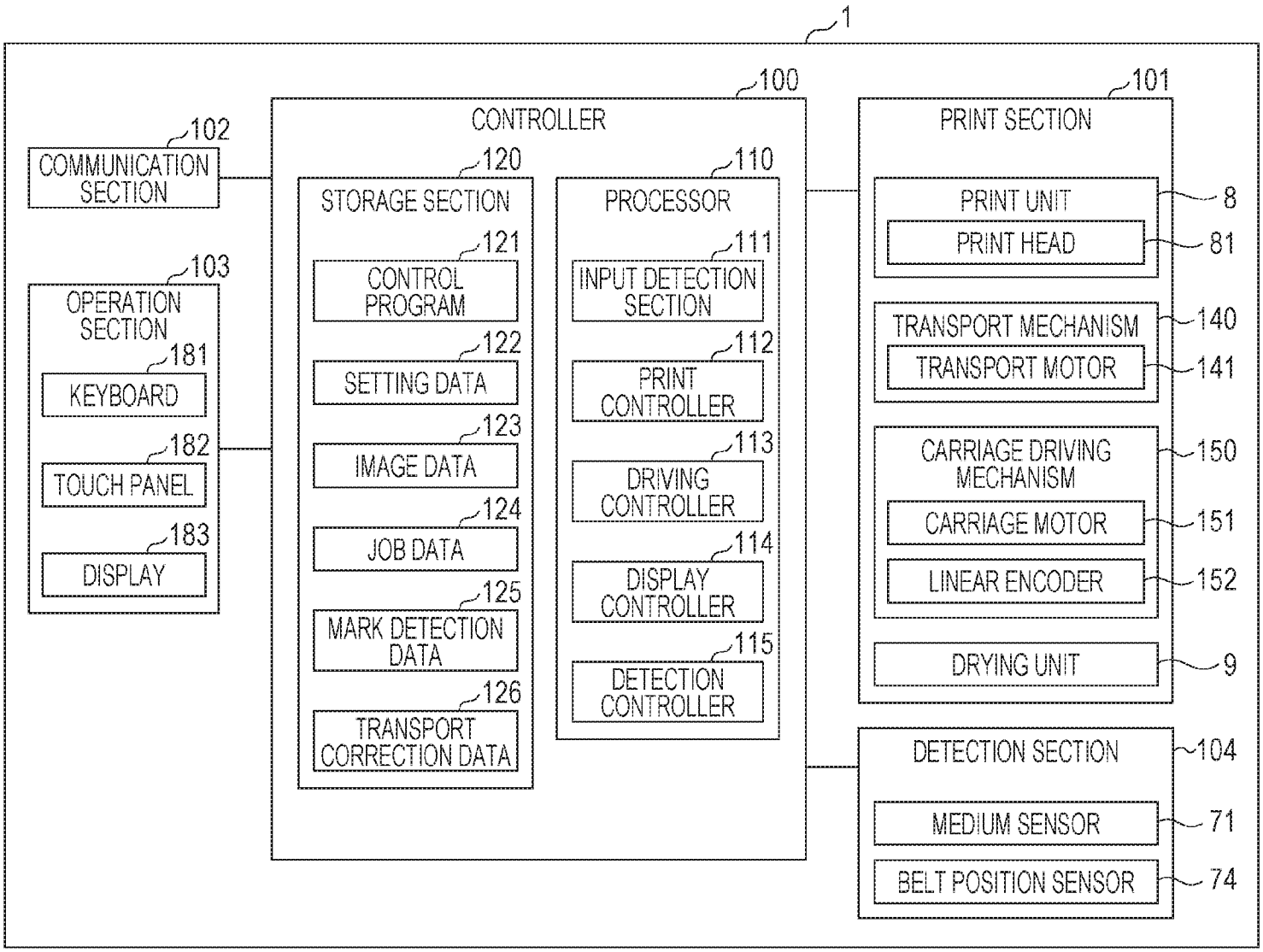
FIG. 4 is a block diagram illustrating a functional configuration of the printer.

FIG. 4 is a block diagram illustrating a functional configuration of the printer 1.

The printer 1 includes the controller 100. The controller 100 includes a processor 110 executing programs of a central processing unit (CPU), a graphics processing unit (GPU), a micro processing unit (MPU), or the like and a storage section 120 and controls sections included in the printer 1. The controller 100 executes various processes by combination of hardware and software including a process of reading a control program 121 stored in the storage section 120 so as to execute a process using the processor 110. The control program 121 corresponds to an example of a control program. Furthermore, the processor 110 reads and executes the control program 121 so as to function as an input detection section 111, a print controller 112, a driving controller 113, a display controller 114, and a detection controller 115.

The storage section 120 has a storage region storing programs to be executed by the processor 110 and data to be processed by the processor 110. The storage section 120 stores the control program 121 to be executed by the processor 110 and setting data 122 including various setting values associated with operation of the printer 1.

The storage section 120 has a nonvolatile storage region storing programs and data in a nonvolatile manner. Furthermore, the storage section 120 may include a volatile storage region temporarily storing programs to be executed by the processor 110 and data to be processed.

A print section 101, a communication section 102, an operation section 103, and a detection section 104 are coupled to the controller 100. The print section 101 includes the print unit 8, the transport mechanism 140, a carriage driving mechanism 150, and the drying unit 9.

The controller 100 controls the print head 81. The print head 81 has a mechanism of ejecting the ink IK from the nozzles using piezoelectric elements and heat elements and ejects the ink IK under control of the controller 100.

The transport mechanism 140 transports the print medium W and includes, in addition to the delivery device 2, the driven rollers 10A to 10C, the transport rollers 3A and 3B, the transport belt 4, and the reeling device 5, the transport motor 141 driving them. The controller 100 controls driving, stop, a rotation direction, and a rotation amount of the transport motor 141. Furthermore, the controller 100 may control a rotation speed of the transport motor 141. The transport motor 141 corresponds to an example of a driving section and a motor of the present disclosure.

The carriage driving mechanism 150 causes the carriage 82 to reciprocate in the scanning direction K and includes a carriage motor 151 serving as a driving source and an linear encoder 152 detecting a position of the carriage 82 in the scanning direction K. The controller 100 detects a position of the carriage 82 based on an output of the linear encoder 152 and moves the carriage 82 by controlling the carriage motor 151. Furthermore, the carriage driving mechanism 150 may include a guide member guiding a movement of the carriage 82 and a gear and a link transmitting power of the carriage motor 151 to the carriage 82. Furthermore, the linear encoder 152 may be omitted when a position of the carriage 82 may be specified based on an operation amount or the like of the carriage motor 151.

The controller 100 controls turning on and off and a heat temperature of a heater included in the drying unit 9.

The detection section 104 includes the medium sensor 71 and the belt position sensor 74.

The controller 100 obtains a detection value of the medium sensor 71 so as to determine whether the print medium W has been detected on the transport belt 4.

The controller 100 continuously obtains a detection value of the belt position sensor 74 at a predetermined sampling cycle. The controller 100 monitors a change in the detection value so as to obtain a timing when the belt position sensor 74A detects one of the marks 50 and a timing when the belt position sensor 74B detects one of the marks 50.

The communication section 102 is constituted by communication hardware including a connector and an interface circuit based on a predetermined communication standard and communicates with an external apparatus of the printer 1 under control of the controller 100. Examples of the external apparatus of the printer 1 include a computer and a server apparatus. When receiving image data 123 from the external apparatus through the communication section 102, the controller 100 stores the received image data 123 in the storage section 120. Furthermore, when receiving job data 124 indicating printing from the external apparatus through the communication section 102, the controller 100 stores the received job data 124 in the storage section 120. A communication method employed in the communication section 102 may be wired communication or wireless communication, and a type of the communication standard may be appropriately selected.

The operation section 103 receives an operation performed by an operator of the printer 1. Although the operation section 103 including a keyboard 181, a touch panel 182, and a display 183 is illustrated as an example in FIG. 4, other input devices may be provided.

The keyboard 181 includes a plurality of keys operated by the operator and outputs operation data indicating an operated key to the controller 100. The display 183 includes a display screen, such as a liquid crystal display panel, and displays various information associated with the operation of the printer 1 under control of the controller 100. The touch panel 182 is disposed on the display screen of the display 183, detects a touch operation on the display screen, and outputs operation data indicating a touched position to the controller 100.

The storage section 120 stores, in addition to the control program 121 and the setting data 122, the image data 123, the job data 124, mark detection data 125, and transport correction data 126.

The image data 123 corresponds to an image to be printed by the printer 1. The job data 124 corresponds to a print job to be executed by the printer 1.

The mark detection data 125 indicates a result of a detection of the marks 50 performed by the belt position sensor 74. The mark detection data 125 may include data indicating timings when the marks 50 are detected by the individual belt position sensors 74A and 74B. Furthermore, the mark detection data 125 may be obtained by a calculation process using timings when the belt position sensors 74A and 74B detect the marks 50. For example, the mark detection data 125 may indicate intervals of the detection timings of the belt position sensors 74A and 74B. Alternatively, the mark detection data 125 may be obtained by converting the intervals of the detection timings into movement directions of the transport belt 4, that is, transport amounts of the transport belt 4. Furthermore, the mark detection data 125 may be associated with oblique transport obtained by a difference between the detection timing of the belt position sensor 74A and the detection timing of the belt position sensor 74B.

The mark detection data 125 may indicate the timing when the belt position sensor 74 detects one of the marks 50 by a transport amount of the transport belt 4. Specifically, when the belt position sensor 74 detects the marks 50, a transport amount of the transport belt 4 obtained from start of the transport to a time of detection, that is, a length of the transport, may be determined as the mark detection data 125. The transport amount of the transport belt 4 in this case corresponds to an amount obtained by a driving amount obtained when the controller 100 drives the transport motor 141. For example, an interval between a timing when the belt position sensor 74A detects the mark 50A and a timing when the belt position sensor 74A detects the mark 50B may be obtained by a distance of a movement of the transport belt 4.

The transport correction data 126 is obtained based on the mark detection data 125. For example, the transport correction data 126 is used by the controller 100 to correct the number of rotations and a rotation speed of the transport motor 141. The transport correction data 126 is used to correct an error between a movement amount of the transport belt 4 obtained from the mark detection data 125 in accordance with a state of the transport belt 4 and a preset movement amount.

For example, a rotation amount of the transport motor 141 corresponding to a movement by 1000 mm of the transport belt 4 is denoted by A. It is assumed here that the mark detection data 125 indicates that a movement amount of the transport belt 4 obtained when the transport motor 141 is rotated by the rotation amount A due to wear of the transport belt 4 is 970 mm. In this case, the transport correction data 126 sets the rotation amount A for a movement by 1000 mm of the transport belt 4.

The input detection section 111 detects an input operation performed by the operator and obtains input content based on operation data input from the operation section 103. The input detection section 111 processes data received through the communication section 102. For example, when receiving the image data 123 or the job data 124 through the communication section 102, the input detection section 111 stores the received data in the storage section 120.

The print controller 112 controls the print section 101 in accordance with the job data 124 so as to cause the print section 101 to execute printing on the print medium W.

The driving controller 113 controls the transport motor 141 so as to control a movement direction and a movement amount of the transport belt 4 and transport of the print medium W. Furthermore, the driving controller 113 controls the carriage motor 151 based on a detection value of the linear encoder 152 so as to control scanning of the carriage 82. The driving controller 113 operates the carriage 82 and the transport belt 4 at a timing when the print controller 112 drives the print head 81 when printing is performed on the print medium W.

The driving controller 113 corrects a rotation speed of the transport motor 141 in accordance with the transport correction data 126 generated by the detection controller 115. Specifically, the driving controller 113 controls correction of an error between a movement amount of the transport belt 4 obtained using the mark detection data 125 and a preset movement amount using the transport correction data 126 and drives the transport motor 141.

The display controller 114 controls the display 183 so that various images are displayed. For example, the display controller 114 displays a message or an image indicating occurrence of oblique transport when the detection controller 115 causes the detection section 104 to detect the oblique transport of the transport belt 4.

The detection controller 115 controls the medium sensor 71 and the belt position sensor 74 so as to obtain detection values of the sensors. The detection controller 115 obtains detection values of the belt position sensors 74A and 74B and stores the detection values or data obtained by monitoring the detection values as the mark detection data 125. For example, the detection controller 115 specifies timings when the belt position sensors 74A and 74B detect the marks 50 based on changes in the detection values of the belt position sensors 74A and 74B and stores the mark detection data 125 indicating the detection timings. The detection controller 115 executes calculation of the transport correction data 126 and detection of the oblique transport based on the mark detection data 125.

Figure 5:
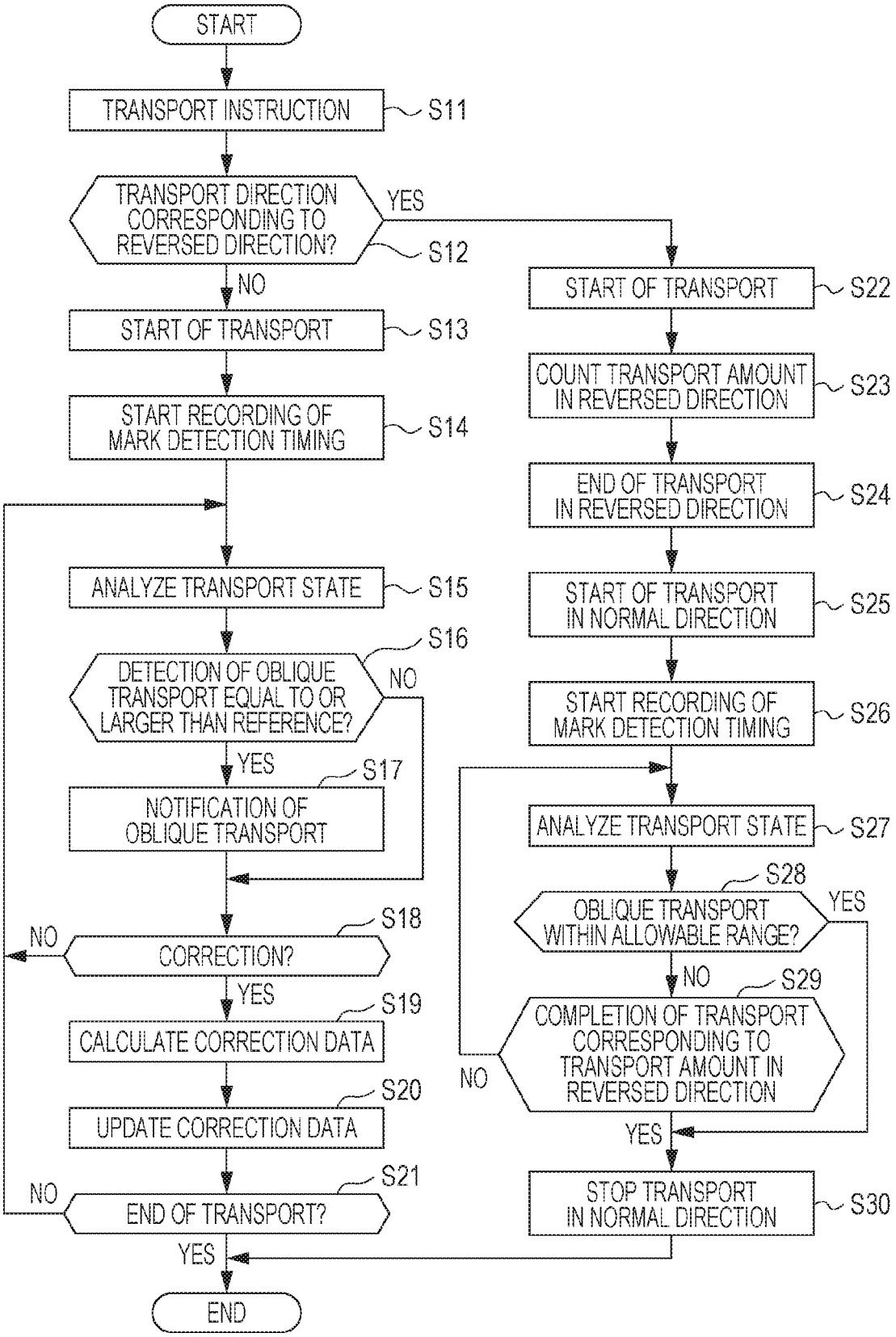
FIG. 5 is a flowchart of an operation of the printer.

FIG. 5 is a flowchart of an operation of controlling a movement of the transport belt 4 performed by the printer 1.

The operation of FIG. 5 is executed under control of the processor 110. Step S11 to step S13, step S21 to step S25, and step S30 correspond to an operation of the driving controller 113, and step S14 to step S20 and step S26 to step S29 correspond to an operation of the detection controller 115.

When detecting an instruction for starting transport of the print medium W (step S11), the controller 100 determines whether a direction of the instructed transport is reversed direction (step S12). The transport instruction may be issued by the job data 124 or input by the operator operating the operation section 103.

When normal transport, such as transport performed when printing is performed on the print medium W in accordance with the job data 124, is performed, a direction of the transport of the print medium W on the transport belt 4 is the belt moving direction F1, that is, a normal direction (step S12; NO). In this case, the controller 100 operates the transport motor 141 so as to start transport (step S13) and starts recording of detection timings of the marks 50 by the belt position sensor 74 (step S14). Specifically, the controller 100 stores the timings when the belt position sensor 74 detects the marks 50 and the mark detection data 125 indicating an interval of the detection timings in the storage section 120 and updates the timings and the data.

The controller 100 analyzes a transport state of the transport belt 4 based on the mark detection data 125 (step S15). In step S15, intervals of detection of the marks 50 by the belt position sensors 74A and 74B are obtained and unevenness of a movement amount of the transport belt 4 is detected based on a change in the intervals. Alternatively, oblique transport of the transport belt 4 is detected based on a difference between a detection timing of the belt position sensor 74A and a detection timing of the belt position sensor 74B, for example.

The controller 100 determines whether oblique transport equal to or larger than a preset reference has been detected (step S16). The preset reference is a value set as a reference warning occurrence of oblique transport and is included in the setting data 122, for example. When oblique transport equal to or larger than the reference is detected (step S16; YES), the controller 100 notifies the operator of occurrence of the oblique transport of the transport belt 4 (step S17). In step S17, the display controller 114 displays the notification, for example. Thereafter, the controller 100 proceeds to step S18.

Furthermore, when oblique motion equal to or larger than the reference is not detected (step S16; NO), the controller 100 proceeds to step S18.

In step S18, the controller 100 determines whether transport of the transport belt 4 is to be corrected in accordance with a result of the analysis in step S15 (step S 18). When it is determined that the correction is to be performed since unevenness of the transport of the transport belt 4 is large (step S18; YES), the controller 100 calculates correction data used to correct control of driving of the transport motor 141 based on the mark detection data 125 (step S19). The controller 100 updates the transport correction data 126 based on the correction data (step S20) and determines whether the transport is to be terminated (step S21). When the transport is to be terminated (step S21; YES), the controller 100 executes a process of stopping the transport motor 141 or the like to terminate this process. Furthermore, when the transport is not to be terminated (step S21; NO), the controller 100 returns to step S15 where the analysis is performed based on the mark detection data 125 associated with a newly detected mark 50. Furthermore, when it is determined that the control of the transport motor 141 is not required to be corrected (step S18; NO), the controller 100 returns to step S15.

On the other hand, when the transport in the belt moving direction F2 is indicated in step S11 (step S21; YES), the controller 100 starts transport (step S22) and counts a transport amount in the belt moving direction F2 (step S23). Thereafter, when the transport in the belt moving direction F2 is terminated (step S24), the controller 100 starts transport in the belt moving direction F1 (step S25). The transport in step S22 to step S24 is the transport instructed in step S11. On the other hand, in step S25, transport in the belt moving direction F1 which is not clearly instructed in step S11 is executed.

The controller 100 operates the transport motor 141 so as to start transport (step S25) and starts recording of detection timings of the marks 50 by the belt position sensor 74 (step S26) similarly to step S14.

The controller 100 analyzes the transport state of the transport belt 4 based on the mark detection data 125 (step S27). In step S27, the controller 100 detects oblique transport of the transport belt 4 based on a difference between a detection timing of the belt position sensor 74A and a detection timing of the belt position sensor 74B. As described above, when transport is performed in the belt moving direction F2, the transport belt 4 may obliquely move. In step S27, it is determined whether the transport belt 4 is obliquely transported and a degree of the oblique transport is obtained. The degree of oblique transport corresponds to a degree of a difference between the detection timing of the belt position sensor 74A and the detection timing of the belt position sensor 74B and is obtained by a transport amount of the transport belt 4 or time.

The controller 100 determines whether the oblique transport of the transport belt 4 is within an allowable range set in advance (step S28). The allowable range of the oblique transport is obtained by adding a margin to a range in which the oblique transport generated due to transport in the belt moving direction F2 is cancelled. When the oblique transport is within the allowable range, it may be determined that the oblique transport of the transport belt 4 is totally cancelled. Furthermore, even a degree of oblique transport of the transport belt 4 is not within the allowance range, it may be determined that print quality of the print medium W may not be affected by the degree of oblique transport.

When it is determined that the oblique transport is not within the allowable range (step S28; NO), the controller 100 determines whether transport in the belt moving direction F1 is completed by an amount corresponding to the amount of transport in the belt moving direction F2 performed in step S22 to step S24 (step S29). When the transport belt 4 is transported in the belt moving direction F2, oblique transport is substantially cancelled by transporting the transport belt 4 in the belt moving direction F1 by an amount corresponding to an amount of transport in the reversed direction. When the transport in the belt moving direction F1 is not completed (step S29; NO), the process returns to step S27.

When the oblique transport is within the allowable range (step S28; YES) and when the transport in the belt moving direction F1 is completed (step S29; YES), the controller 100 stops transport in the belt moving direction F1 (step S30) and this process is terminated.

In step S27 to step S29, when the transport belt 4 is transported in the belt moving direction F2, the oblique transport caused by a movement in the reversed direction is cancelled. Specifically, the transport belt 4 is transported in the belt moving direction F1 by an amount corresponding to the amount of the movement in the belt moving direction F2. Here, when the oblique transport is within the allowable range even before the transport in the belt moving direction F1 reaches a predetermined transport amount, the transport in the belt moving direction F1 is stopped. In this way, unnecessary transport is suppressed when a degree of oblique transport is small or when the oblique transport is cancelled in an early stage, and accordingly, efficiency may be improved.

When a movement of the transport belt 4 in the belt moving direction F2 is instructed in step S11, the transport is stopped after the transport in the belt moving direction F1 is performed, and therefore, the transport in the belt moving direction F1 is executed to cancel the oblique transport before printing on the print medium W is performed.

As described above, the printer 1 of the first embodiment to which the present disclosure is employed includes the print unit 8 performing printing on the print medium W and the transport belt 4 on which the print medium W is mounted. The printer 1 includes the transport motor 141 transporting the print medium W by moving the transport belt 4 in the determined belt moving direction F1 and the detection section 104 detecting the marks 50 for detection of a transport amount formed on the side ends of the transport belt 4. The printer 1 further includes the driving controller 113 controlling the transport motor 141 based on a result of the detection performed by the detection section 104. The driving controller 113 obtains an error of movement amounts of the transport belt 4 based on the result of the detection performed by the detection section 104 and performs control such that the obtained error is corrected.

As a method for controlling the printer 1, control is performed such that the marks 50 for detection of a movement amount formed on the side ends of the transport belt 4 are detected, an error of movement amounts of the transport belt 4 is obtained based on a result of the detection of the marks 50, and the obtained error is corrected.

The control program 121 is executed by the controller 100 to cause the detection section 104 to detect the marks 50 for detection of a movement amount formed on the side ends of the transport belt 4. The control program 121 obtains an error of transport amounts of the transport belt 4 based on a result of the detection of the marks 50 and performs control of correcting the obtained error.

According to the printer 1 to which the print apparatus, the method for controlling the print apparatus, and the control program according to the present disclosure are employed, a transport state of the transport belt 4 may be easily detected by detecting the marks 50 formed on the transport belt 4 by the belt position sensor 74. Furthermore, when the mark line 51 and the mark line 53 are formed in positions which do not overlap with the print medium W, a state of the transport belt 4 may be detected in real time while printing on the print medium W is executed, for example. Accordingly, the state of the transport belt 4 may be detected without performing a complicated operation which deteriorates throughput of the printing on the print medium W.

The driving controller 113 controls correction of an error between a movement amount of the transport belt 4 obtained based on the result of the detection of the detection section 104 and a preset movement amount. Therefore, in addition to an advantage of detection of the state of the transport belt 4 without performing a complicated operation, a movement amount of the transport belt 4 may be appropriately controlled in accordance with the state of the transport belt 4. Accordingly, the operation of transporting the print medium W may be stabilized and deterioration of print quality of the print medium W may be suppressed.

The printer 1 includes the transport motor 141 as a power source driving the transport belt 4, and the driving controller 113 adjusts a rotation speed of the transport motor 141 so as to correct an error of the movement amounts of the transport belt 4. Accordingly, in addition to an advantage of detection of the state of the transport belt 4 without performing a complicated operation, a transport amount of the print medium W may be appropriately controlled in accordance with the state of the transport belt 4. Therefore, the operation of transporting the print medium W may be stabilized and deterioration of print quality of the print medium W may be suppressed.

The plurality of marks 50 are formed on the opposite ends of the transport belt 4 based on the belt moving direction F1 at an equal interval in the belt moving direction F1. The driving controller 113 detects oblique transport of the transport belt 4 based on a result of detection of the marks 50 formed on one of the side ends of the transport belt 4 using the detection section 104 and a result of detection of the marks 50 formed on the other of the side ends of the transport belt 4 using the detection section 104. Therefore, the oblique transport of the transport belt 4 may be detected without executing a complicated operation.

The driving controller 113 performs control such that the transport belt 4 is moved in the belt moving direction F1 when the transport motor 141 performs an operation of moving the transport belt 4 in the belt moving direction F2 which is a reversed direction of the belt moving direction F1. In this control, before the print unit 8 performs printing on the print medium W, transport in the belt moving direction F1 is performed in accordance with a movement amount of the transport belt 4 in the belt moving direction F2. By this, oblique transport caused by the movement direction of the transport belt 4 in the belt moving direction F2 may be cancelled.

The detection section 104 includes the belt position sensor 74 which is disposed on a downstream relative to the mounting start position I1 where mounting of the print medium W on the transport belt 4 is started in the belt moving direction F1 and on an upstream relative to the print unit 8 and which optically reads the marks 50. Therefore, airborne droplet of the ink IK ejected from the print unit 8 does not affect detection by the belt position sensor 74, and accordingly, the detection may be stably performed by the belt position sensor 74 for a long period of time. Accordingly, frequency of maintenance of the belt position sensor 74 may be suppressed and state of the transport belt 4 may be detected without executing a complicated operation.

Note that the belt position sensor 74 may not be fixed on the printer 1 but may be mounted on the carriage 82 so as to be movable in the scanning direction K, for example. Specifically, the print unit 8 includes the print head 81 forming an image by ejecting ink to the print medium W and the carriage 82 which has the print head 81 mounted thereon and which performs scanning in a direction intersecting with the belt moving direction F1. The detection section 104 may be realized as a configuration which is attached to the carriage 82 and which includes the belt position sensor 74 optically reading the marks 50. With this configuration, a sensor mounted on the carriage 82 may detect a state of the transport belt 4 without executing a complicated operation. For example, in the operation of performing printing on the print medium W, a state of the transport belt 4 may be detected by detecting the marks 50 using the sensor when the carriage 82 is operated.

The embodiment described above is merely a concrete example to which the present disclosure is applied and the present disclosure is not limited to this.

Although a configuration in which the marks 50 are arranged in the opposite end portions of the transport belt 4 is illustrated in the foregoing embodiment, the present disclosure is not limited to this. At least a plurality of marks 50 are arranged in the movement direction of the transport belt 4 and the marks 50 may be arranged in only one of the side portions of the transport belt 4 in the scanning direction K, for example.

Furthermore, although the plurality of marks 50 aligned on the transport belt 4 have the same shape in FIGS. 2 and 3, the present disclosure is not limited to this. For example, the marks 50 having states, such as shapes, differently detected by the belt position sensor 74 may be aligned on the transport belt 4. Specifically, graphics or signs having different shapes may be employed as the marks 50 or numbers or image codes may be employed as the marks 50. In this case, the marks 50 detected by the belt position sensor 74 may be specified and identified from among the plurality of marks 50 in accordance with a result of detection performed by the belt position sensor 74. The controller 100 may identify the marks 50 and individually obtain detection timings of the individual marks 50 by the belt position sensor 74. Therefore, a portion where an interval between adjacent marks 50 is changed from the interval D of the reference state may be specified in the belt moving direction F1 of the transport belt 4. Accordingly, the transport correction data 126 for appropriately correcting a movement amount of the transport belt 4 may be obtained and correction may be performed with higher accuracy.

Furthermore, although the printer 1 printing an image while the rolled print medium W is transported is described as an example in the foregoing embodiment, the present disclosure is not limited to this. The present disclosure is applicable to a print apparatus performing printing by fixing and holding a print medium W, such as fabric, to be printed and moving a print head 81 relative to the print medium W, for example. For example, the present disclosure is applicable to a so-called garment printer performing printing by fixing cloth or sewing fabric as a print medium W and ejecting ink on the print medium W. Furthermore, the present disclosure may be applied to a print apparatus performing printing on not only woven fabrics but also knit fabric, paper, and sheets of synthetic resin.

The present disclosure is applicable to not only apparatuses solely used as a print apparatus but also apparatuses having functions other than printing, such as multifunction peripherals having a copy function and a scan function and POS terminal devices, for example.

Furthermore, the printer 1 may use the ink IK which cures due to irradiation with ultraviolet rays, and in this case, an ultraviolet irradiation apparatus may be disposed on the printer 1 instead of the drying unit 9. Furthermore, the printer 1 may include a cleaner device cleaning the print medium W dried by the drying unit 9, and other detailed configurations of the printer 1 may be arbitrarily changed.

Furthermore, functional sections included in the controller 100 may be configured as the control program 121 to be executed by the processor 110 as described above, and in addition, may be realized by a hardware circuit incorporating the control program 121. Furthermore, the control program 121 may be received by the printer 1 from a server apparatus or the like through a transmission medium.

Furthermore, the functions of the controller 100 may be realized by a plurality of processors or semiconductor chips.

Furthermore, step units of the operation illustrated in FIG. 5 are divided in accordance with main processing content to easily realize the operation of the printer 1, and the present disclosure is not limited by a division method of processing units and names of processing units. The operation may be further divided into a larger number of step units in accordance with processing content. Furthermore, the division may be made such that one step unit may include a larger number of processes. Furthermore, an order of the steps may be appropriately changed within the scope of the present disclosure.

What is claimed is:

1. A print apparatus comprising:

a print section configured to perform printing on a print medium;

a belt on which the print medium is mounted;

a driving section configured to move the belt in a predetermined movement direction so as to transport the print medium;

a detection section configured to detect a plurality of marks formed on side ends of the belt, to therefore detect a movement amount of the belt; and a driving controller configured to control the driving section based on a result of the detection performed by the detection section, wherein the driving controller obtains an error of movement amounts of the belt based on the result of the detection performed by the detection section and performs control such that the error of movement amounts of the belt is corrected.

2. The print apparatus according to claim 1, wherein the driving controller performs control such that an error between a movement amount of the belt obtained based on a result of the detection of the detection section and a preset movement amount is corrected.

3. The print apparatus according to claim 1, wherein the driving section includes a motor as a power source driving the belt, and wherein the driving controller adjusts a rotation speed of the motor so as to correct the error between the movement amounts of the belt.

4. The print apparatus according to claim 1, wherein the plurality of marks are formed at an equal interval in the movement direction in opposite ends of the belt with the movement direction as a reference, and wherein the driving controller detects oblique transport of the belt based on a result of detection of the marks formed on one of the side ends of the belt performed by the detection section and a result of detection of the marks formed on the other of the side ends of the belt performed by the detection section.

5. The print apparatus according to claim 1, wherein, when the driving section performs an operation of moving the belt in a direction opposite to the movement direction, the driving controller performs control such that the belt is moved in the movement direction by a movement amount of the belt in the opposite direction before the print section performs printing on the print medium.

6. The print apparatus according to claim 1, wherein the detection section is an optical sensor which is disposed on a downstream of a mounting start position where mounting of the print medium on the belt is started in the movement direction and on an upstream of the print section and which optically reads the marks.

7. The print apparatus according to claim 1, wherein the print section includes a print head forming an image by ejecting ink to the print medium and a carriage which includes the print head and which performs scanning in a direction intersecting with the movement direction, and wherein the detection section is an optical sensor which is mounted on the carriage and which optically reads the marks.

8. A method for controlling a print apparatus which includes a print section performing printing on a print medium and a belt on which the print medium is mounted and which transports the print medium by moving the belt in a predetermined movement direction, the method comprising:

detecting marks formed on side ends of the belt, to therefore detecting a movement amount of the belt; and performing control such that an error between movement amounts of the belt is obtained based on a result of the detection of the marks and the error between amounts of the belt is corrected.

9. A non-transitory computer-readable storage medium storing a control program to be executed by a control section controlling a print apparatus which includes a print section performing printing on a print medium and a belt on which the print medium is mounted and which transports the print medium by moving the belt in a predetermined movement direction, the program causes the controller to:

detect marks formed on side ends of the belt, to therefore detect a movement amount of the belt; and perform control such that an error between movement amounts of the belt is obtained based on a result of the detection of the marks and the error between movement amounts is corrected.

* * * * *